US012799694B2

(12) United States Patent
Mcnolty

(10) Patent No.: US 12,799,694 B2
(45) Date of Patent: Nov. 17, 2026

(54) CUTTING EDGE MOUNTING SLIDE FOR A SNOW PLOW

(71) Applicant: YELLOWHEAD ROAD AND BRIDGE (VANDERHOOF) LTD., Vanderhoof (CA)

(72) Inventor: Jordon Mcnolty, Banderhoof (CA)

(73) Assignee: YELLOWHEAD ROAD AND BRIDGE (VANDERHOOF) LTD., Vanderhoof (CA)

( * ) Notice: Subject to any disclaimer, the term of this patent is extended or adjusted under 35 U.S.C. 154(b) by 304 days.

(21) Appl. No.: 18/560,782

(22) PCT Filed: May 24, 2022

(86) PCT No.: PCT/CA2022/050821
§ 371 (c)(1),
(2) Date: Nov. 14, 2023

(87) PCT Pub. No.: WO2022/251950
PCT Pub. Date: Dec. 8, 2022

(65) Prior Publication Data

US 2024/0254706 A1 Aug. 1, 2024

Related U.S. Application Data

(60) Provisional application No. 63/195,848, filed on Jun. 2, 2021.

(51) Int. Cl.
*E01H 5/06* (2006.01)

(52) U.S. Cl.
CPC ..... *E01H 5/061* (2013.01)

(58) Field of Classification Search
CPC ..... E01H 5/061; E01H 5/066; E01H 5/065; E01H 5/068; E01H 5/067; E01H 5/062; A01B 15/02
See application file for complete search history.

(56) References Cited

U.S. PATENT DOCUMENTS 2,674,052 A * 4/1954 James ..... E02F 3/8152 172/701.3
3,477,520 A * 11/1969 Gray ..... A01B 15/00 172/753

(Continued)

FOREIGN PATENT DOCUMENTS

DE 102017001590 A1 * 8/2018 ..... E01H 5/061

OTHER PUBLICATIONS

Thorlabs, "Post Holders: Rectangular Channel in the Inner Bore", Dec 11, 2019, Figure 1.2, <https://www.thorlabs.com/ post-holders-inner-bore-has-channel-to-seat-posts-stably-and-repeatably?tabName=Insights> (Year: 2019).*

*Primary Examiner* — Christopher J Sebesta
*Assistant Examiner* — Blake E Scoville

(57) ABSTRACT

Mounting slide for attaching a cutting edge to a plow of a snow-clearing vehicle, where the cutting edge has a cross-sectional profile where its engagement end is wider than its body, the mounting slide having: an opening on a bottom face; a first side; a second side; and a channel extending from the first side to the second side, the channel being open on the bottom face; wherein the slide may be mounted to the plow via a series of bolts and nuts; wherein the channel is configured to slidably receive therein from the first end the engagement end of the cutting edge, and wherein the opening is sized to accommodate the body of the cutting edge, but not its engagement end. The cross-sectional profile of the cutting edge may be T-shaped. A snow plow assembly comprising a plow, the mounting slide and a cutting edge is also disclosed.

11 Claims, 5 Drawing Sheets

(56) References Cited

U.S. PATENT DOCUMENTS

| | | | | |
|---|---|---|---|---|
| 4,164,821 | A * | 8/1979 | Vanchot | E01H 5/061<br>172/701.3 |
| 7,467,485 | B2 * | 12/2008 | Lachance | E01H 5/062<br>172/264 |
| 10,407,857 | B2 * | 9/2019 | Talou | F16B 5/0685 |

* cited by examiner

CUTTING EDGE MOUNTING SLIDE FOR A SNOW PLOW

FIELD OF THE INVENTION

The invention relates to cutting edges used on snow plow blades for various snow-clearing vehicles. More specifically, the invention relates to the installation and replacement of cutting edges on any type of snow-clearing vehicles.

BACKGROUND

A conventional snow plow blade on a plow truck (or other such vehicles used for clearing snow) is used to scrape and push away material that accumulates on surfaces such as roads, highways and driveways. A conventional snow plow blade is generally comprised of 2 components; a plow and a cutting edge. Generally, the plow is primarily used to push/direct the accumulated snow or other debris, whereas the cutting edge is primarily used to scrape off winter accumulations (ice, snow, compact snow and/or sand) from the surface of the road and/or surface debris from the area that is being worked. These plow blades can be used with and/or installed upon various snow-clearing vehicles, such as loaders, graders, plow trucks, All-Terrain-Vehicles ("ATVs"), tractors, etc.

The present invention is generally illustrated and described herein, in particular, in relation to an underbody plow. An underbody plow (sometimes also referred to as a "scraper") is a snow plow blade that is attached to the undercarriage of a snow-clearing vehicle, which helps to scrape up compact snow and ice. However, it should be understood that the present invention may also be applied to any of the other different types of snow plow blades found on various snow-clearing vehicles, e.g., a front plow, a wing plow, or a split plow.

An underbody plow is typically a steel carriage on the underside of a snow-clearing vehicle or plow truck that mounts a cutting edge using a series of nuts and bolts. A cutting edge is usually made from heavy steel and has a hard sharp edge that gets mounted onto the underbody plow (a cutting edge is installed/mounted on other kinds of plows in a similar fashion).

The conventional way in which a cutting edge is attached to a plow is through a series of bolts and nuts, spaced along the length of the cutting edge and plow, with the bolts running through both the cutting edge and plow. The bolts are typically in the form of a "carriage bolt", meaning it has a tapered head with part of the shaft being square to "lock in" the cutting edge to prevent spinning of the bolt. The cutting edge bolt holes are spaced and centred to align with the bolt holes in the plow. Typically, the total length of a cutting edge may consist of several separate cutting edge sections, although this will depend on the size and type of the plow and of the snow-clearing vehicle. For example, the cutting edges of a full-sized municipal snow plow truck used for clearing roads and highways may typically be made up of three cutting edge sections installed side-by-side. For ease of reference, these separate cutting edge sections, will sometimes be referred to collectively as a single cutting edge.

Over time, a cutting edge wears down and will need to be replaced. With this conventional bolt-on cutting edge system, it can be time consuming and tricky to change the cutting edge as one has to remove all the nuts and bolts to install a new cutting edge, using air tools. Further, in the case of a underbody plow, an operator would have to physically get under the vehicle to be able to undo the bolts and remove/replace each of the cutting edge sections in order to install a new cutting edge, putting himself at considerable risk of injury. Further, most of the time when it is necessary to change a cutting edge of an underbody plow blade, the snow-clearing vehicle is "in the field", which can mean difficult conditions for the operator to work in; typically, it is cold and wet, and there is snow, ice and melting snow dropping from the underside of the vehicle onto the operator lying on the ground, making it difficult and uncomfortable. Furthermore, this process is very difficult to do with one person, as that person has to hold up a heavy cutting edge or cutting edge section in position and simultaneously insert bolts, and then fasten nuts onto the bolts, all the while lying under the vehicle/truck in an awkward position, thus putting the operator at risk of injury. In addition, the process of one operator replacing a cutting edge by him/her self can be very time consuming depending on the conditions. This causes downtime for the vehicle/truck, which is valuable time that could otherwise be spent on the road.

The above-mentioned conventional snow plow blade configuration is used on a variety of snow-clearing vehicles, including residential snow plows, commercial snow plows, split plows, wing plows, ATV snowplows, tractor plows, and grader blades. Each of these have the same cutting edge changing process, which can be time consuming and present an injury risk for the operator.

It would be desirable to provide an improved cutting edge installation method that addresses some of the shortcomings of the conventional approach.

BRIEF SUMMARY OF THE INVENTION

In accordance with one aspect of the present invention, disclosed herein is a mounting slide for attaching one or more cutting edge sections to a plow for a snow-clearing vehicle, wherein each of the one or more cutting edge sections has a body, and an engagement end that is disposed proximate to an upper edge of the cutting edge sections, the cutting edge sections having a substantially uniform cross-section, and wherein the cutting edge sections have a cross-sectional profile such that the engagement end has a horizontal width at its widest point that is greater than a width of the body, the mounting slide being elongate and having: (i) a front face; (ii) a backing member on a rear face; (iii) a top face; (iv) an opening on a bottom face; (v) a first side end; (vi) a second side end, the second end being at an end opposite to the first side end; and (vii) a channel extending from the first side end to the second side end, along a length of the mounting slide, the channel being open on the bottom face; wherein the mounting slide is adapted to be mounted and secured, through the backing member, to a front blade of the plow via a securing means; wherein the channel of the slide is configured to slidably receive therein, from the first side end of the slide, the engagement end of the one or more cutting edge sections, and wherein the opening is configured to be able to accommodate the body of the one or more cutting edge sections, but not the engagement end of the one or more cutting edge sections.

In some aspects, the mounting slide and plow are unitary.

In accordance with yet another aspect, the securing means is a plurality of bolts, inserted into a plurality of corresponding bolt holes in the mounting slide and the plow, and a plurality of corresponding nuts.

In some aspects, the mounting slide additionally comprises retaining means for securing the cutting edge sections once the cutting edge sections are in an installed position. In some aspects, the retaining means is one or more keeper bolts, insertable through the top face into the channel or into bolt holes in one or more of the cutting edge sections.

In some aspects, the plow is an underbody plow, a split plow, a front plow or a wing plow.

In accordance with yet another aspect, the snow-clearing vehicle is a plow truck, a loaders, a graders, an All-Terrain-Vehicle or a tractor.

In accordance with another aspect of the present invention, the cross-sectional profile of the engagement end is T-shaped, circular, triangular, oval, hexagonal, or diamond shaped.

In accordance with another aspect of the present invention, also disclosed herein is a plow blade assembly for a snow-clearing vehicle, comprising: (i) a plow; (ii) a mounting slide as previously described, wherein the mounting slide is mounted to a front blade of the plow via a securing means; and (iii) one or more cutting edge sections, wherein each of the one or more cutting edge sections has a body, and an engagement end that is disposed proximate to an upper edge of the cutting edge sections, the cutting edge sections having a substantially uniform cross-section, and the cutting edge sections having a cross-sectional profile such that the engagement end has a horizontal width at its widest point that is greater than a width of the body; wherein a channel of the mounting slide is adapted to slidably receive therein, from a first end of the slide, the engagement end of the one or more cutting edge sections, and wherein an opening of the mounting slide is adapted to be able to accommodate the body of the one or more cutting edge sections, but not the engagement end of the one or more cutting edge sections.

Also disclosed herein is a mounting bracket configured to attach to a plow using securing means, the mounting bracket having a mounting slide for slidably receiving one or more cutting edge sections of a cutting edge, wherein the cutting edge sections are T-shaped.

It is contemplated that the present invention will allow an operator to more quickly, efficiently, comfortably and safely change a cutting edge of a snow plow blade on a snow-clearing vehicle. The operator can simply mount the slide to the plow once; then with all future replacements of the cutting edge or cutting edge sections, it is relatively easy to remove any keeper bolts and slide out the old/worn cutting edge sections, and then slide in the new/replacement cutting edge sections and replace the keeper bolts. Further, this task can be done by one person. It is contemplated that the use of the present invention will be highly cost-effective, given the savings in resources, improved time management for the employees/operators and the reduced down time of the vehicle/truck. This also significantly reduces risk of injury to employees/operators by eliminating the need to get into awkward or uncomfortable positions to remove a worn cutting edge and installing a replacement cutting edge (e.g. without having to crawl under the vehicle or have snow/ice/melting snow drip onto him), having to lift the cutting edge into place, and allows the operator to work with better visibility.

DETAILED DESCRIPTION OF THE INVENTION

Figure 1:
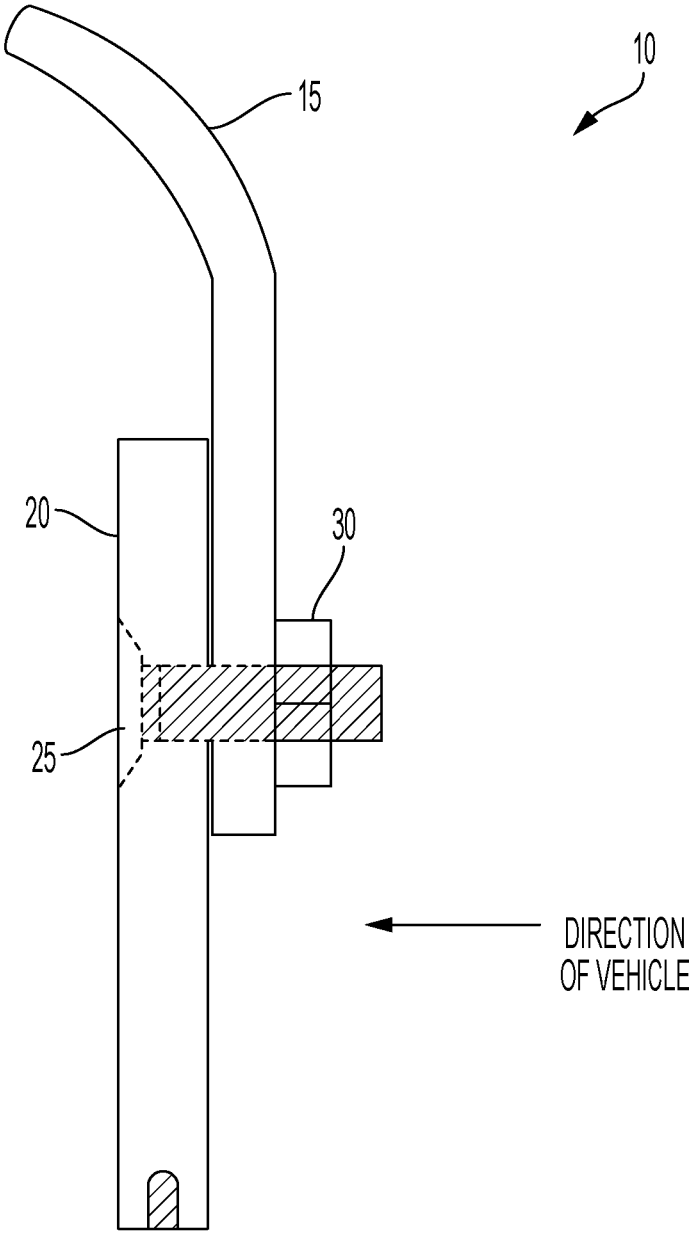
FIG. 1 PRIOR ART
FIG. 1 is a cross-sectional side view of a prior art plow blade assembly, showing a plow and a cutting edge.

It will be instructive to provide a brief explanation and illustration of how conventional snow plow blades are typically configured, and the process by which a cutting edge for the snow plow blade is installed on/attached to the plow and by which a worn cutting edge is replaced. Referring to FIG. 1, this shows a cross-sectional side view of a prior art plow blade assembly 10, showing a plow 15 and a cutting edge 20. As previously mentioned, the snow plow blade (sometimes also referred to herein as a plow blade assembly) may be used for an underbody plow for a snow-clearing vehicle. Other kinds of plows (such as front plows and wing plows) typically will have a similar basic construction. The plow blade assembly 10 essentially comprises a plow 15 and a cutting edge 20. The cutting edge 20 is an elongate, substantially planar blade of rigid construction. The cutting edge 20 and plow are provided with a plurality of bolt holes disposed along the length of the cutting edge and plow, which align together. The cutting edge may be a single unitary blade, or it may comprise several separate cutting edge sections installed side-by-side. For example, a typical full-size underbody plow for a snow plow truck may consist of 3 cutting edge sections, which are respectively, 3 feet, 4 feet and 3 feet long—making a cutting edge that is 10 feet long in total.

The cutting edge 20 is shown attached and secured to a plow 15 using a plurality of bolts 25 (one of which is shown in FIG. 1) inserted from the front face of the cutting edge, through the bolt holes, and secured by corresponding nuts 30. Usually, the bolts are in the form of carriage bolts having a tapered head, with part of the shaft being square to the bolt hole, to prevent the bolt from spinning in the bolt hole after it is secured. Typically, the bolt hole on the front face of the cutting edge may also be countersunk in order to allow the head of the bolt to be flush with the front face of the cutting edge. In use, the plow blade assembly 10 may be mechanically actuated such that the cutting edge 20 contacts the surface of the road, thereby scraping snow/ice/sand/compacted snow and other accumulations from the road surface. The cutting edge 20 is oriented substantially vertically. The cutting edge 20 is typically disposed on the forward facing face of the plow blade assembly 10 (see direction of vehicle). In operation, the cutting edges are constantly scraping accumulations, contacting the hard, uneven road surface and moving at high speeds, meaning they are subject to constant and heavy stress; thus, cutting edges frequently and quickly wear out and oftentimes need to be replaced whilst out in the field to ensure optimal snow-clearing operation.

As previously mentioned, this conventional configuration of plow and cutting edge has a number of practically shortcomings. It can be challenging and/or dangerous to install a cutting edge or replace a worn cutting edge out "in the field". In the case of an underbody plow, an operator would typically need to lie on the ground or crawl under the vehicle in order to access the nuts towards the rear of the plow blade assembly, and remove these nuts using air/power tools, typically in cold, wet, low visibility conditions. (Access to the nuts on the rear face of the plow blade assembly is particularly necessary when carriage bolts have been used to secure the cutting edge, which is typically the case). During reinstallation, the operator would need to lift a replacement cutting edge (which is typically quite heavy), or at least a replacement cutting edge section, then position it so that the bolt holes line up, insert the bolts, and then again have to crawl under the vehicle to attach the nuts to the bolts and secure them using air/power tools. This difficulty is exacerbated when the operator is working alone.

Figure 2:
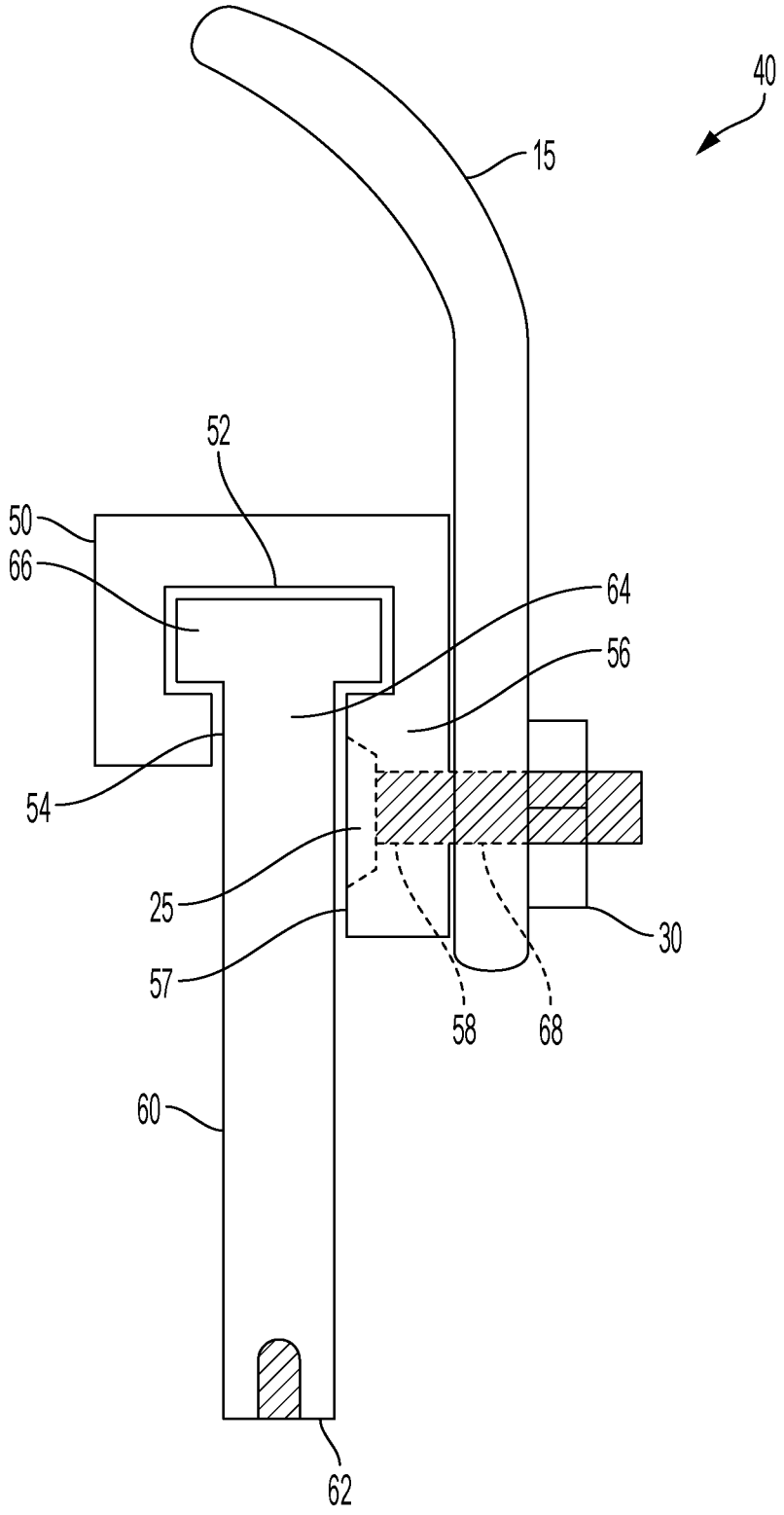
FIG. 2 is a cross-sectional side view of a plow blade assembly in accordance with an embodiment of the present invention.

FIG. 2 is a cross-sectional side view of an improved plow blade assembly in accordance with an embodiment of the present invention. In essence, the plow blade assembly 40 provides an advantageous engagement mechanism for mounting a cutting edge 60 to a plow 15. A mounting bracket or mounting slide 50 (sometimes referred to herein as a "slide", for ease of reference) is affixed to the plow 15, using a series of blots 25 and nuts 30 in the same manner as previously described. The slide 50 is elongate and generally spans the desired length of the cutting edge 60. The slide 50 has a substantially uniform cross-section along its length. The slide has an elongate backing member 56, which abuts the plow when the slide is mounted on the plow. The slide is provided with a plurality of slide bolt holes 58 along its length, which align with a plurality of plow bolt holes 68. Bolts 25 (only one of which is visible in FIG. 2) are inserted into the slide bolt holes 58 and plow bolt holes 68, and the slide is mounted and secured to the plow with nuts 30. The bolts are preferably configured such that, when they are in place and the slide is secured to the plow, the head of each bolt is either flush with the front face 57 of the backing member 56, or it is recessed within the slide so that the head does not extend beyond the front face 57 of the backing member 56. The slide 50 includes a channel 52 spanning its length, from a first side end to a second side end. At the lower end of the channel 52, there is an opening 54 spanning the length of the slide. The channel 52 is configured and sized to slidably receive from one end thereof, a correspondingly shaped/sized engagement end 66 of a cutting edge 60 or of a cutting edge section. In this case, the cutting edge 60 is configured with an engagement end 66.

Figure 5:
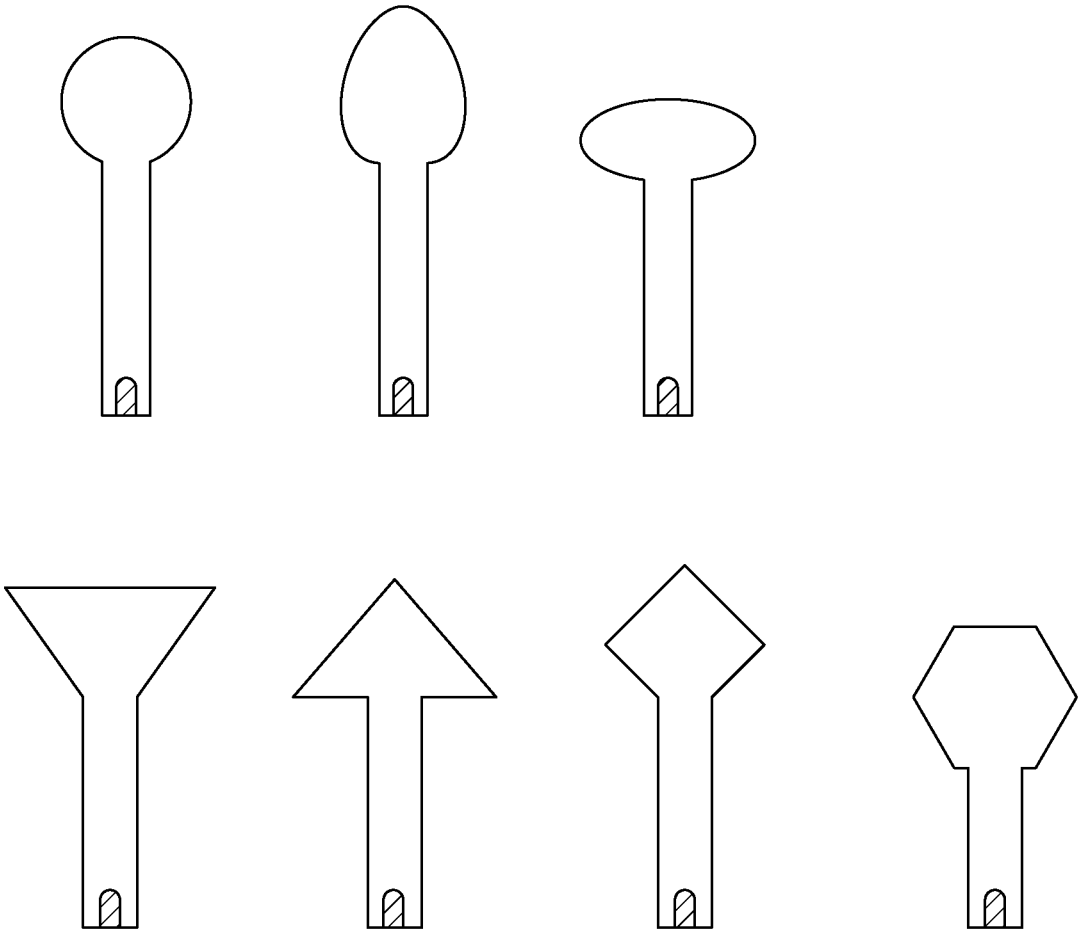
FIG. 5 illustrates a number of possible alternative shapes/configurations for the cutting edge head of the cutting edge.

In the preferred embodiment shown in FIG. 2, the engagement end (also sometimes referred to herein as the cutting edge head) 66 is in the form of a "T"-shaped head. It has been found that a T-shaped head works very well, as this "slides" well and provides good sturdiness, and allows for relatively straightforward construction/tooling. It should be appreciated that alternative shapes for the cutting edge head 66 and channel 52 may also be used. What matters is that the cutting edge head 66 is configured and sized to fit snugly into the channel, so that when it is so engaged, the cutting edge will remain securely in the channel, and will not drop vertically out of the channel and become disengaged. Generally, this can be achieved by configuring the cutting edge 60 such that the cutting edge body 64 is narrower than the cutting edge head 66 (in the transverse direction perpendicular to its longitudinal length) engagement head. FIG. 5 illustrates a number of possible alternative shapes/configurations for the cutting edge head (shown in side view).

With this type of arrangement, it is considerably easier to install a cutting edge or replace a worn one. The major advantage is that the slide only needs to be mounted once; thereafter it should not be necessary to access the nuts 30 and/or bolts 25, even if a cutting edge needs to be replaced. To install a cutting edge 60, the cutting edge head 66 is lined up with the channel 52 of the slide 50 from the side. Once the cutting edge head 66 is properly aligned and engaged with the channel 52, it can be readily pushed/slid all the way into the channel 52 from the side, until the cutting edge 60 is in an "installed position". Note also that once the cutting edge head is engaged with the channel, the channel of the slide effectively functions to "guide" the further engagement of cutting edge into the channel; this makes the installation process markedly easier, particularly for a lone operator, than with the prior art, where the cutting edge would have to be lifted and carefully manoeuvred under the vehicle into the proper position.

In alternative embodiments, the mounting slide and plow as above described may be unitary, i.e. integrated together as a single unit.

Figure 3:
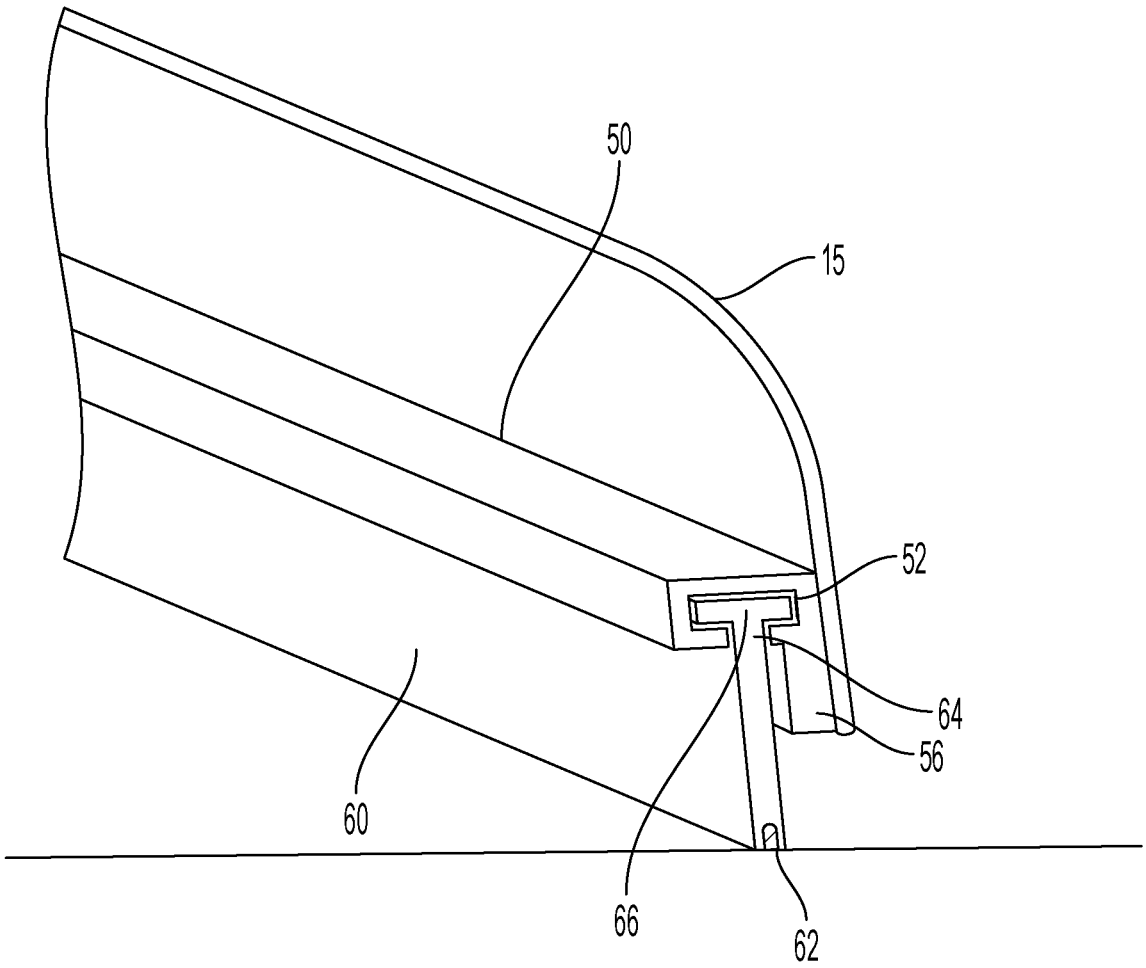
FIG. 3 is a diagrammatic perspective view of part of the plow blade assembly of the present invention, showing the cutting edge installed in the mounting slide in an installed/engaged position.
Figure 4:
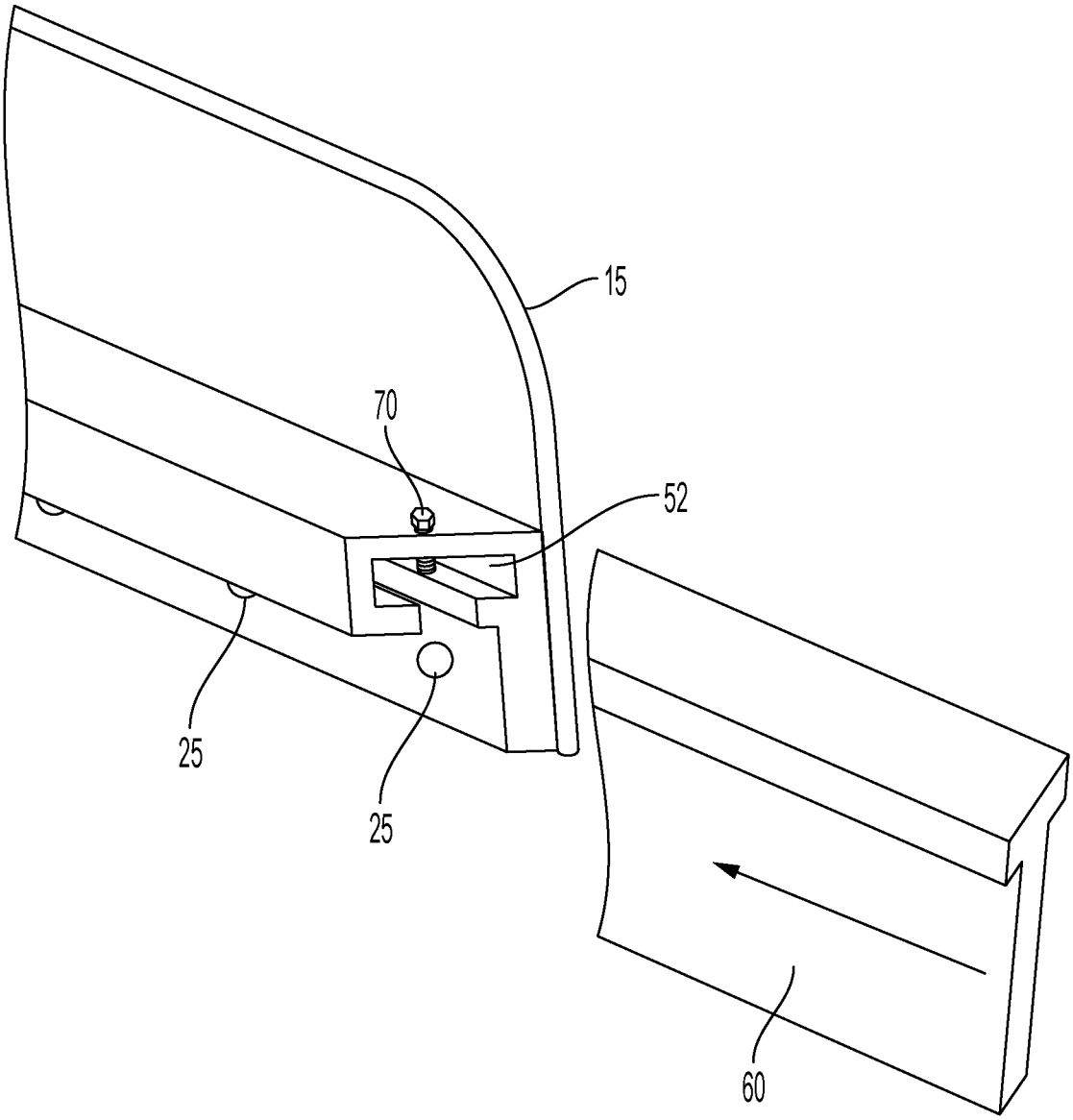
FIG. 4 is a diagrammatic perspective view of a part of the plow blade assembly with the cutting edge having been removed.

Although not specifically illustrated, it is also contemplated that the cutting edge head may also be adapted to facilitate its initial engagement with the channel, for example by chamfering one or both ends of the cutting edge head or otherwise making its leading end slightly smaller, or by making one or both ends of the channel slightly larger at its outer ends. FIG. 3 is a diagrammatic perspective view of part of the plow blade assembly of the present invention, showing the cutting edge installed in the slide, in an installed position. FIG. 4 is a diagrammatic perspective view of a part of the plow blade assembly, with the cutting edge having been removed therefrom.

The slide 50 may be configured so that the cutting edge can be slid in from either side or from one side only (in which case, the channel will be closed at the opposite side or it may also be provided with some form of retaining mechanism as discussed below). Where a cutting edge comprises several cutting edge sections instead of a single cutting edge, each cutting edge section is slid into the channel, one after the other. The cutting edge 60 will also be provided with a locking or retaining mechanism to keep the cutting edge (or the cutting edge sections) in the installed position, so that it cannot slide out of the installed position. The retaining mechanism may simply be in the form of a keeper bolt 70 (see FIG. 4), located proximate to one or both outer ends of the slide. The keeper bolt 70 may simply be inserted and/or secured such that it at least partially blocks the channel, thus preventing the cutting edge from being slid back out from the installed position. Alternatively, the slide and cutting edge may be provided with aligned bolt holes (e.g. on or near the top of the slide), through which the keeper bolt may be inserted and/or secured, thus retaining the cutting edge 60 in the installed position. Alternatively, the slide may be provided with a cover, lid, cap, latch or bolt (not shown) which may be actuated between an unlocked and a locked position; when in a locked position, it also similarly retains the cutting edge 60 (or cutting edge sections, as the case may be) in an installed position and prevents movement of the cutting edge out of the channel 52 from its installed position.

Similarly, when a worn cutting edge needs to be replaced, one of the retaining mechanisms is unlocked (e.g. the keeper bolt 70 is removed). Then the cutting edge 60 can simply be slid out of the channel 52 of the slide, through the unlocked side. Once the worn cutting edge or cutting edge sections are removed, the replacement cutting edge or cutting edge sections can be installed and locked into the installed position as described before.

This process allows the operator to work in a more upright position and reduces the extent to which the operator needs to lift the cutting edge or hold it carefully in position, reducing the risk of injury and also avoiding the melting snow and ice, since the operator does not have to lay on the ground. In practice, this allows a lone operator to replace a worn cutting edge in under 5 minutes. This affords a marked improvement over the conventional system, saving many hours of operational downtime as well as avoiding worker injuries.

When manufacturing a plow blade assembly of the present invention, fabricators may simply create a T-shape for the cutting edge to slide into the channel, instead of a flat piece for bolting the cutting edge to the plow. This provides the same capabilities in terms of operational productivity in moving accumulations from the road, but minimises the downtime to change cutting blades and the risk to an operator. This innovation can be applied to not only commercial snow plows, but can also be modified to fit other plows and plow blades, such as split plows, wing plows, all-terrain vehicle (ATV) snowplows, tractor plows, and grader blades.

It is to be understood that embodiments of the invention disclosed are not limited to the structures, process steps, or materials disclosed herein, but are extended to equivalents thereof as would be recognised by those ordinarily skilled in the relevant arts. It should also be understood that terminology employed herein is used for the purpose of describing embodiments only and is not to be limited.

The described features, structures, or characteristics may be combined in any suitable manner in one or more embodiments. One skilled in the relevant art will recognize, however, that the invention can be practiced without one or, more of the specific details, or with other methods, components, materials, etc. In other instances, well-known structures, materials, or operations are not shown or described in detail to avoid obscuring aspects of the invention. While specific embodiments have been described and illustrated, such embodiments should be considered illustrative of the invention only and not as limiting the invention as construed in accordance with the accompanying claims.

The invention claimed is:

1. A plow blade assembly for a snow-clearing vehicle, the plow blade assembly comprising:

a plow;

a mounting slide secured to the plow, the mounting slide having:

a first side end;

a second side end, opposite the first side end; and a channel extending along a length of the mounting slide from the first side end to the second side end, the channel being adapted to slidably receive at least one cutting edge section from the first side end of the mounting slide, and the channel having an opening at a bottom face; and a plurality of cutting edge sections slidably received within the channel, wherein each of the cutting edge sections has a body, and an engagement end that is disposed proximate to an upper edge of the cutting edge section, wherein a cross-sectional profile of the engagement end has a horizontal width at its widest point that is greater than a width of the body, such that the body passes through the opening of the channel while the engagement end is retained within the mounting slide, wherein the mounting slide spans an entire length of the plow.

2. The plow blade assembly of claim 1, wherein the mounting slide and the plow are unitary.

3. The plow blade assembly of claim 1, wherein the mounting slide is secured to the plow by a plurality of bolts, inserted into a plurality of corresponding bolt holes in the mounting slide and the plow, and a plurality of corresponding nuts.

4. The plow blade assembly of claim 1, wherein the mounting slide additionally comprises retaining means for securing the plurality of cutting edge sections in an installed position.

5. The mounting slide plow blade assembly of claim 4, wherein the retaining means is one or more keeper bolts, insertable through the mounting slide and into the channel or into bolt holes in one or more of the cutting edge sections.

6. The plow blade assembly of claim 1, wherein the plow is an underbody plow, a split plow, a front plow or a wing plow.

7. The plow blade assembly of claim 1 wherein the snow-clearing vehicle is any one of: a plow truck, a loader, a grader, an All-Terrain-Vehicle and a tractor.

8. The plow blade assembly of claim 1, wherein the cross-sectional profile of the engagement end is one of T-shaped, circular, triangular, oval, hexagonal, and diamond shaped.

9. The plow blade assembly of claim 1, wherein the mounting slide comprises a backing member on a rear face, and wherein the backing member abuts and is secured to the plow.

10. The plow blade assembly of claim 9, wherein the backing member comprises a plurality of slide bolt holes that align with a plurality of plow bolt holes on the plow, wherein the backing member is secured to the plow by a plurality of bolts that extend through the slide and plow bolt holes and are secured by a plurality of corresponding nuts, and wherein the head of each bolt is flush with or recessed from a front face of the backing members.

11. A mounting slide for securing to a plow, and a plurality of cutting edge sections for being slidably received in the mounting slide, wherein the mounting slide and each of the cutting edge sections are as defined in claim 9.

* * * * *